US010026566B1

(12) United States Patent
Chen et al.

(10) Patent No.: US 10,026,566 B1
(45) Date of Patent: Jul. 17, 2018

(54) KEYBOARD DEVICE

(71) Applicant: Primax Electronics Ltd., Taipei (TW)

(72) Inventors: Bo-An Chen, Taipei (TW); Wei-Yung Huang, Taipei (TW); Tsu-Yi Chen, Taipei (TW); Chun-Yuan Liu, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/596,110

(22) Filed: May 16, 2017

(30) Foreign Application Priority Data

Jan. 6, 2017 (TW) ..... 106100440 A

(51) Int. Cl.
*H01H 3/12* (2006.01)
*H01H 13/705* (2006.01)

(52) U.S. Cl.
CPC ..... *H01H 3/125* (2013.01); *H01H 13/705* (2013.01)

(58) Field of Classification Search
CPC ..... H01H 3/125; H01H 13/705; H01H 3/00; H01H 3/02; H01H 3/12; H01H 9/02; H01H 13/00; H01H 13/70; H01H 13/702; H01H 13/84; H01H 13/85; H01H 13/86; H01H 2003/00; H01H 2003/02; H01H 2003/12; H01H 2009/02; H01H 2201/00; H01H 2205/00; H01H 2205/004; H01H 2221/00; H01H 2223/00; H01H 2223/03; H01H 2231/002; H01H 2233/00; H01H 2233/002; H01H 2233/03; H01H 2233/07; H01H 2237/00; H01H 2237/004; H01H 2239/006; H01H 2239/076
USPC .... 200/5 A, 343, 345, 318, 318.1, 329, 332, 200/333, 335, 337, 341, 344
See application file for complete search history.

(56) References Cited

U.S. PATENT DOCUMENTS 9,087,650 B2 * 7/2015 Ma ..... H01H 3/122
9,837,220 B2 * 12/2017 Hou ..... H01H 3/122
9,837,221 B2 * 12/2017 Liao ..... H01H 3/125

* cited by examiner

*Primary Examiner* — Edwin A. Leon
(74) *Attorney, Agent, or Firm* — Kirton McConkie; Evan R. Witt

(57) ABSTRACT

A keyboard device includes a key structure, a switch circuit board, a base plate and a buffering strip. The key structure includes a keycap and a stabilizer bar. The stabilizer bar is connected with the keycap. A first end of the buffering strip is fixed in a first coupling structure of the keycap. A second end of the buffering strip is fixed in a second coupling structure of the keycap. The buffering strip is contacted with the stabilizer bar and filled in a gap between the stabilizer bar and the first coupling structure. Since the possibility of resulting in the collision between the stabilizer bar and the keycap is minimized, the keycap device is capable of reducing noise.

10 Claims, 12 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices. The subject of the present invention is related to a keyboard device.

FIG. 1 is a schematic top view illustrating the outer appearance of a conventional keyboard device. As shown in FIG. 1, plural key structures 10 and 10' are disposed on a top surface of the conventional keyboard device 1. The key structures 10 have the ordinary sizes. The key structures 10' are relatively longer. That is, the length of the key structure 10 is slightly larger than the width of the key structure 10, and the length L1 of the key structure 10' is much larger than the width W1 of the key structure 10'. When one of the key structures 10 and 10' is depressed by the user's finger, a corresponding key signal is generated to the computer, and thus the computer executes a function corresponding to the depressed key structure. Generally, the user may depress the key structures 10 and 10' to input corresponding English letters (or symbols) or numbers or execute various functions (e.g., F1~F12 or Delete). For example, the conventional keyboard device 1 is a keyboard for a notebook computer.

The structures of the conventional keyboard device will be illustrated as follows. FIG. 2 is a schematic exploded view illustrating a portion of the conventional keyboard device and taken along a viewpoint. FIG. 3 is a schematic exploded view illustrating a portion of the conventional keyboard device and taken along another viewpoint. Please refer to FIGS. 1, 2 and 3. The conventional keyboard device 1 comprises plural key structures 10 and 10', a metallic base plate 11 and a membrane circuit board 12. The membrane circuit board 12 comprises plural membrane switches 121 corresponding to the plural key structures 10 and 10'. Each of the plural key structures 10 and 10' comprises a keycap 101, at least one scissors-type connecting element 102 and a rubbery elastomer 103. The scissors-type connecting element 102 is connected between the keycap 101 and the metallic base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The rubbery elastomer 103 is arranged between the keycap 101 and the metallic base plate 11. Moreover, the rubbery elastomer 103 comprises a contacting part 1031.

While the keycap 101 of any key structure 10 or 10' is depressed and moved downwardly relative to the metallic base plate 11, the first frame 1021 and the second frame 1022 of the scissors-type connecting element 102 are switched from an open-scissors state to a stacked state. Moreover, as the keycap 101 is moved downwardly to compress the rubbery elastomer 103, the corresponding membrane switch 121 is pushed and triggered by the contacting part 1031 of the rubbery elastomer 103. Consequently, the membrane circuit board 12 generates a corresponding key signal. When the keycap 101 of the key structure 10 or 10' is no longer depressed, the keycap 101 is moved upwardly relative to the metallic base plate 11 in response to an elastic force of the rubbery elastomer 103. Meanwhile, the first frame 1021 and the second frame 1022 are switched from the stacked state to the open-scissors state again, and the keycap 101 is returned to its original position.

In the keyboard device 1, the key structures 10' and the key structures 10 are distinguished. As shown in the drawings, the length L1 of the key structure 10' is much larger than the width W1 of the key structure 10'. Since the length L1 of the keycap 101 of the key structure 10' is relatively longer, the keycap 101 is readily rocked while the key structure 10' is depressed. That is, the operating smoothness of the key structure 10' is adversely affected, and even the tactile feel of the user is impaired. For increasing the operating smoothness of the key structure 10', the key structure 10' is further equipped with a special mechanism. For example, the key structure 10' further comprises a first stabilizer bar 104, a second stabilizer bar 105 and plural coupling structures 106. The first stabilizer bar 104 comprises a first linking bar part 1041 and two first hook parts 1042. The two first hook parts 1042 are located at two ends of the first stabilizer bar 104, respectively. The second stabilizer bar 105 comprises a second linking bar part 1051 and two second hook parts 1052. The two second hook parts 1052 are located at two ends of the second stabilizer bar 105, respectively.

The metallic base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first linking bar part 1041 of the first stabilizer bar 104 and the second linking bar part 1051 of the second stabilizer bar 105 are pivotally coupled to the corresponding coupling structures 106 of the keycap 101 of the key structure 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively.

FIG. 4 schematically illustrates the actions of the first stabilizer bar and the second stabilizer bar of the conventional keyboard device. While the keycap 101 of the key structure 10' is moved upwardly or downwardly relative to the metallic base plate 11, the first stabilizer bar 104 is moved in a first direction D11 or a second direction D12 and rotated in a first rotating direction D13 or a second rotating direction D14. Similarly, the second stabilizer bar 105 is moved in the first direction D11 or the second direction D12 and rotated in the first rotating direction D13 or the second rotating direction D14. By the first stabilizer bar 104 and the second stabilizer bar 105, the key structure 10' is kept stable and not inclined while the key structure 10' is moved upwardly or downwardly relative to the metallic base plate 11. Moreover, the uses of the first stabilizer bar 104 and the second stabilizer bar 105 are helpful to increase the strength of the keycap 101.

However, the conventional keyboard device 1 still has two drawbacks. Firstly, as mentioned above, the first stabilizer bar 104 and the second stabilizer bar 105 are coupled to the corresponding coupling structures 106. Since the first stabilizer bar 104 is engaged with the corresponding coupling structures 106, there is still a gap between the first stabilizer bar 104 and each coupling structure 106. The first stabilizer bar 104 frequently collides with the corresponding coupling structures 106 to generate noise. The problems of the second stabilizer bar 105 are similar to those of the first stabilizer bar 104, and are not redundantly described herein. Secondly, if the region farther away from the coupling structure 106 of the keycap 101 (e.g., the rim of the keycap 101) is depressed, the exerted force of the user is difficultly transmitted to the first stabilizer bar 104 or the second stabilizer bar 105. Under this circumstance, the smoothness of the linkage between the first stabilizer bar 104 or the second stabilizer bar 105 and the keycap 101 is impaired. Consequently, the tactile feel of depressing the key structure is deteriorated.

Therefore, there is a need of providing a keyboard device with reduced noise.

SUMMARY OF THE INVENTION

An object of the present invention provides a keyboard device with reduced noise.

Another object of the present invention provides a keyboard device with enhanced tactile feel.

In accordance with an aspect of the present invention, there is provided a keyboard device. The keyboard device includes a key structure, a switch circuit board, a base plate and a buffering strip. The key structure includes a keycap and a stabilizer bar. The keycap is exposed outside the keyboard device and includes a first coupling structure. The stabilizer bar is located under the keycap and fixed in the first coupling structure. The switch circuit board is located under the key structure. When the switch circuit board is triggered, a key signal is generated. The base plate is located under the switch circuit board and connected with the stabilizer bar. The key structure is supported by the base plate. A first end of the buffering strip is fixed in the first coupling structure and contacted with the stabilizer bar. The buffering strip is filled in a gap between the stabilizer bar and the first coupling structure.

In an embodiment, the first coupling structure includes a supporting part and a locking part. The supporting part is disposed on an inner surface of the keycap and located at a first side of the first coupling structure. The stabilizer bar is supported by the supporting part. The locking part is disposed on the inner surface of the keycap and located at a second side of the first coupling structure. The locking part is engaged with the first end of the buffering strip. The buffering strip includes a sustaining part, an extension hook part and a coupling post. The sustaining part is located at the first end of the buffering strip and formed on a first sidewall of the buffering strip. The sustaining part is contacted with the stabilizer bar. The extension hook part is located at the first end of the buffering strip and formed on a second sidewall of the buffering strip. The extension hook part is coupled with the locking part. The coupling post is located at a second end of the buffering strip and fixed on the keycap or the base plate.

From the above descriptions, the present invention provides the keyboard device. The buffering strip is arranged between the keycap and the stabilizer bar. Moreover, the buffering strip is fixed between the keycap and the base plate. The buffering strip is filled in the gap between the keycap and the stabilizer bar. Since the buffering strip is contacted with the stabilizer bar, the stabilizer bar is in close contact with the keycap and the possibility of resulting in the collision between the stabilizer bar and the keycap is minimized. Moreover, the buffering strip is used as a connecting bridge between the stabilizer bar and the keycap. The depressing force received by the keycap can be transmitted to the stabilizer bar through the buffering strip. Since the linkage between the stabilizer bar and the keycap becomes smoother, the tactile feel of depressing the key structure is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technologies, the present invention provides a keyboard device. First of all, the structure of the keyboard device will be illustrated as follows.

Figure 1:
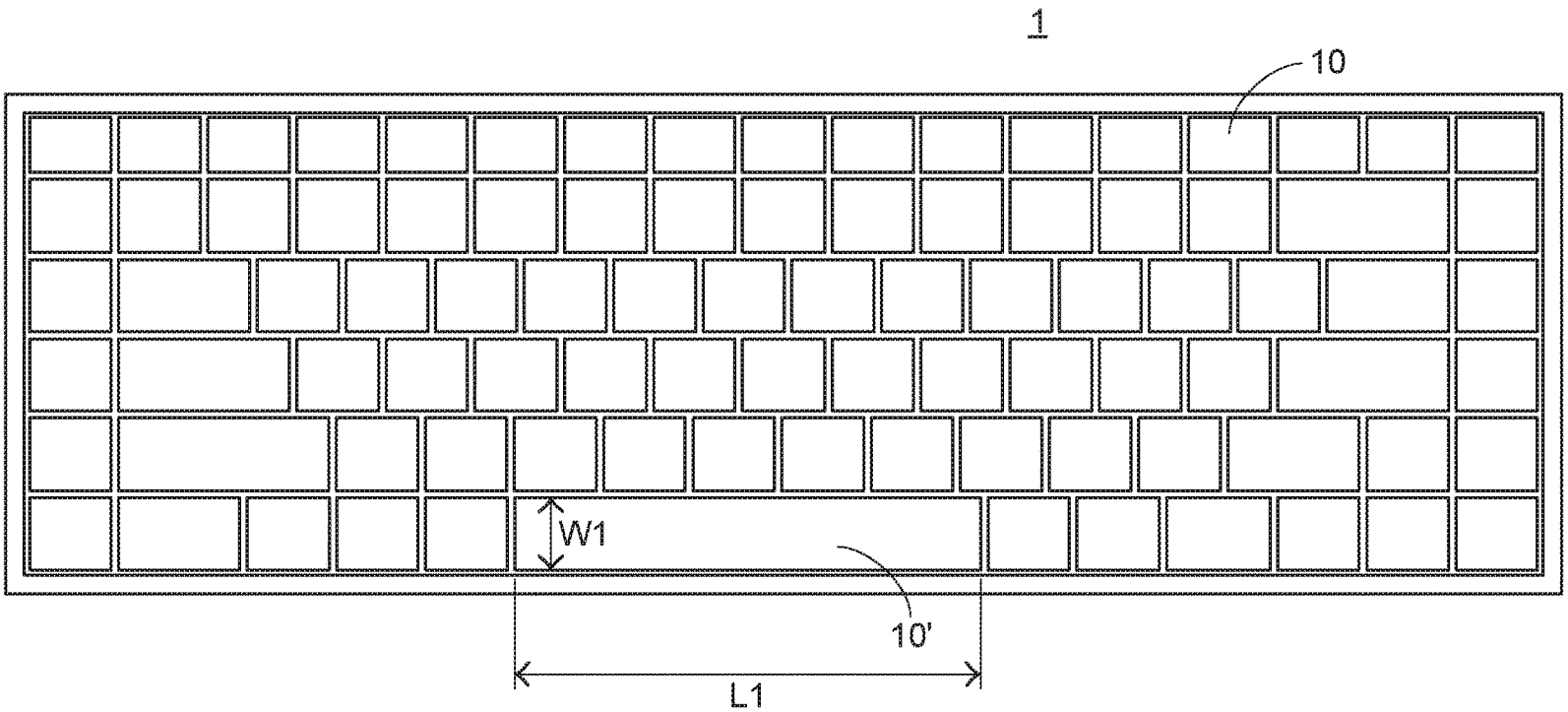
FIG. 1 PRIOR ART
FIG. 1 is a schematic top view illustrating the outer appearance of a conventional keyboard device.
Figure 2:
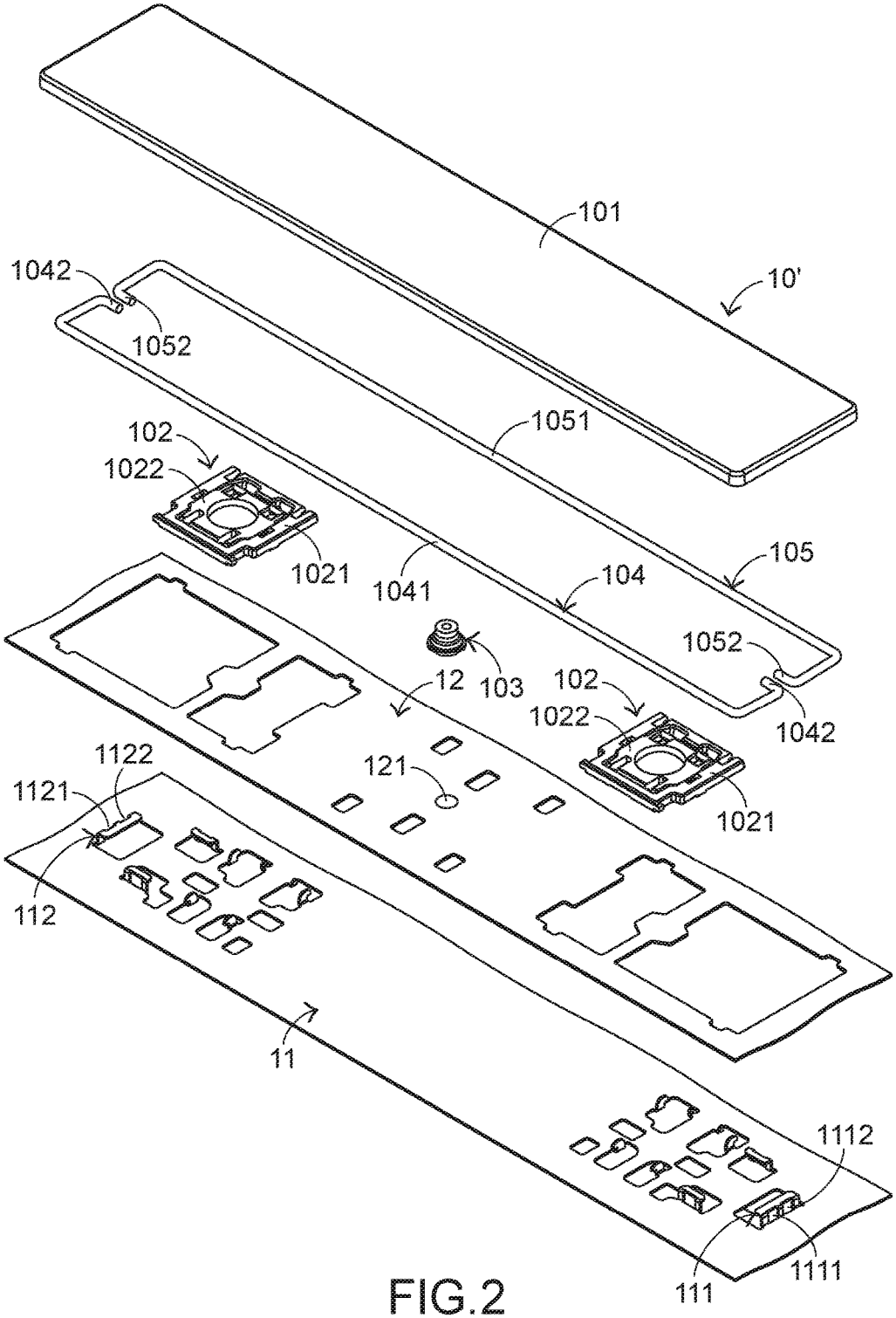
FIG.2 PRIOR ART
FIG. 2 is a schematic exploded view illustrating a portion of the conventional keyboard device and taken along a viewpoint.
Figure 3:
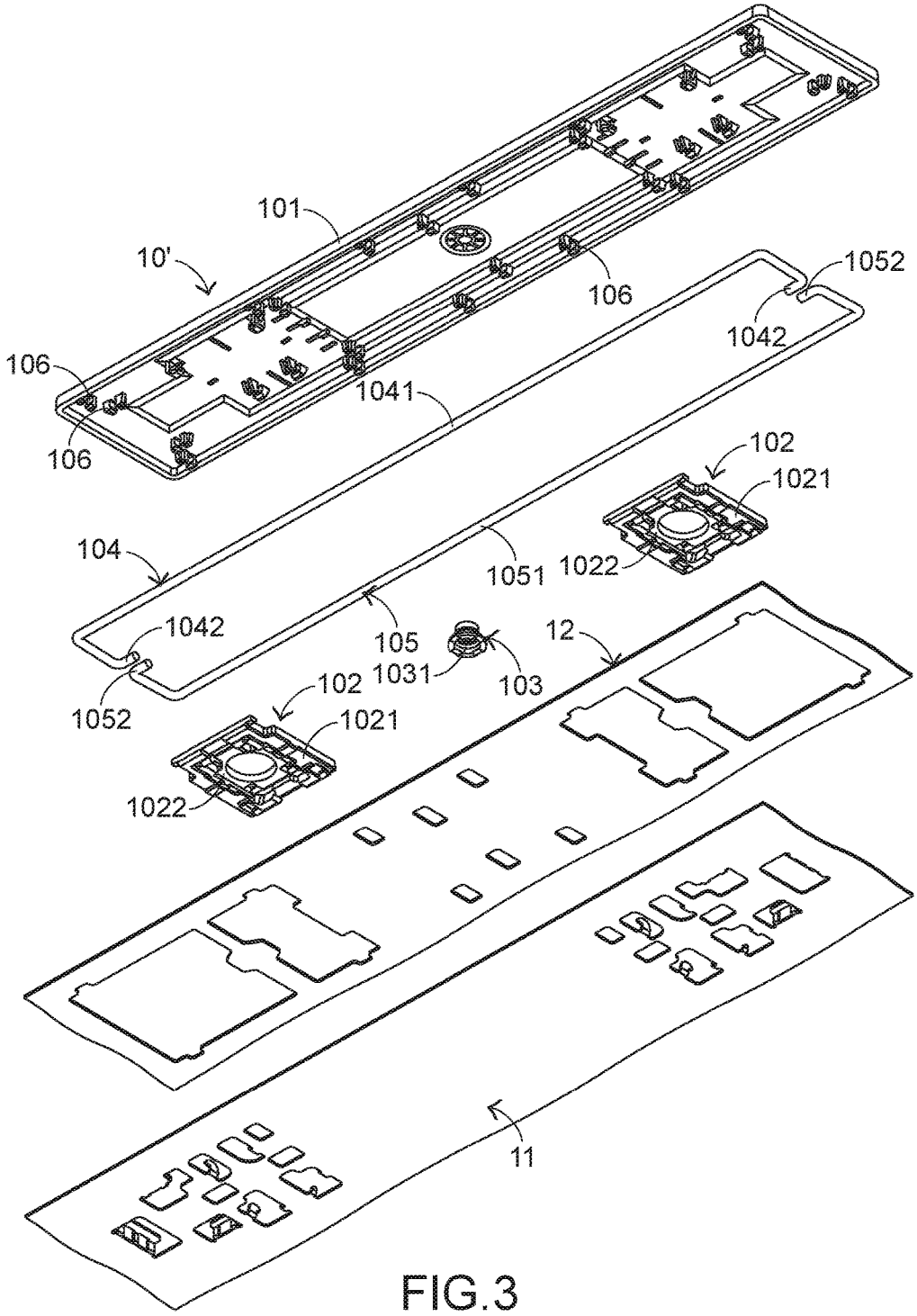
FIG.3 PRIOR ART
FIG. 3 is a schematic exploded view illustrating a portion of the conventional keyboard device and taken along another viewpoint.
Figure 4:
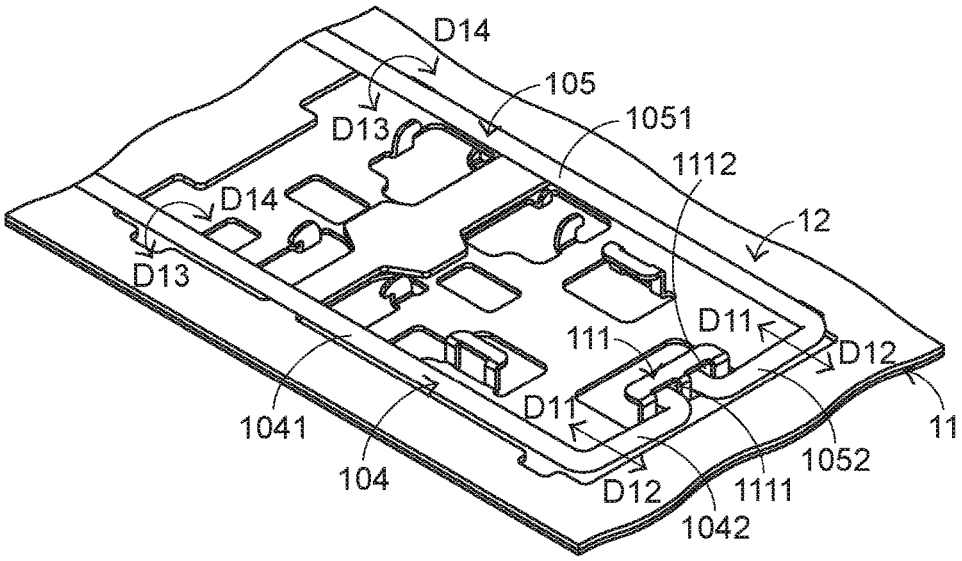
FIG.4 PRIOR ART
FIG. 4 schematically illustrates the actions of the first stabilizer bar and the second stabilizer bar of the conventional keyboard device.
Figure 5:
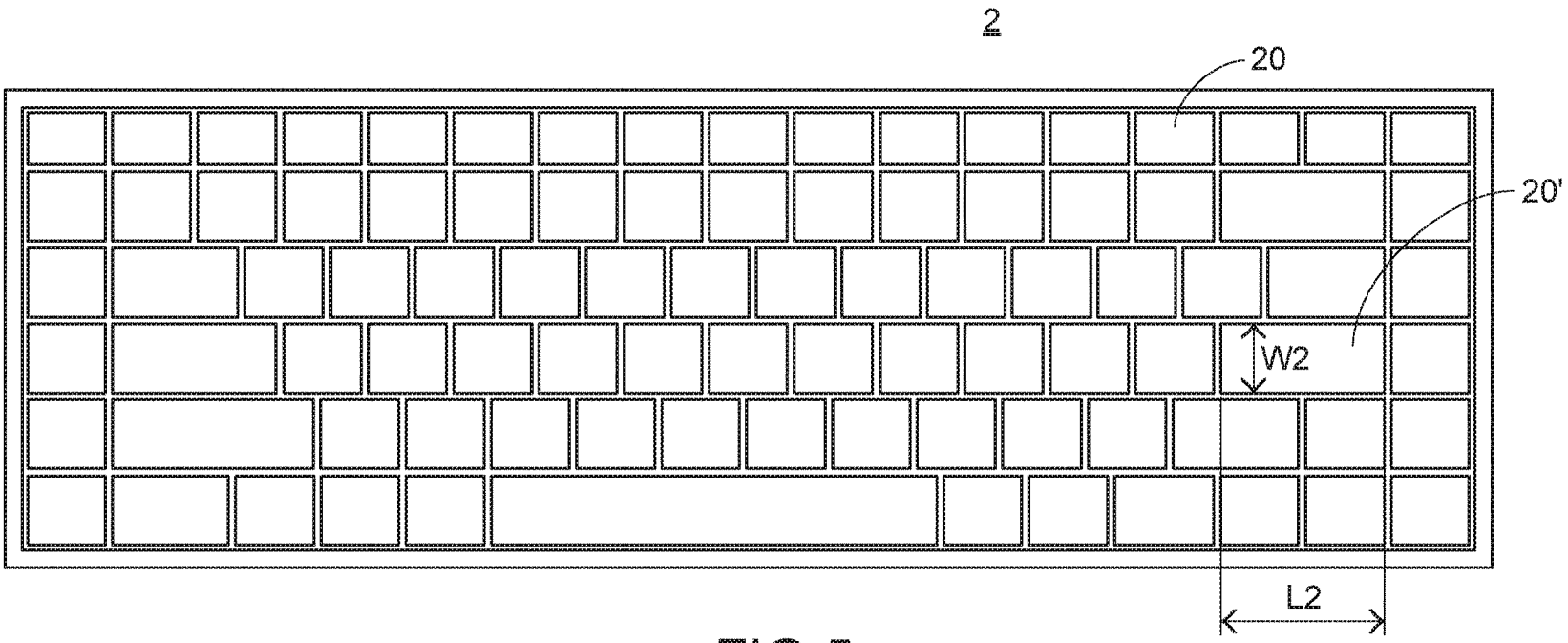
FIG. 5 is a schematic top view illustrating the outer appearance of a keyboard device according to a first embodiment of the present invention.

FIG. 5 is a schematic top view illustrating the outer appearance of a keyboard device according to a first embodiment of the present invention. The keyboard device 2 comprises plural key structures 20 and 20'. These key structures 20 and 20' are exposed outside the keyboard device 2. When one of the key structures 20 and 20' is depressed by the user's finger, a corresponding key signal is generated to a computer (not shown) that is in communication with the keyboard device 2. Consequently, the computer executes a function corresponding to the depressed key structure. The length of the key structure 20 is slightly larger than the width of the key structure 20. The length L2 of the key structure 20' is much larger than the width W2 of the key structure 20'.

Figure 6:
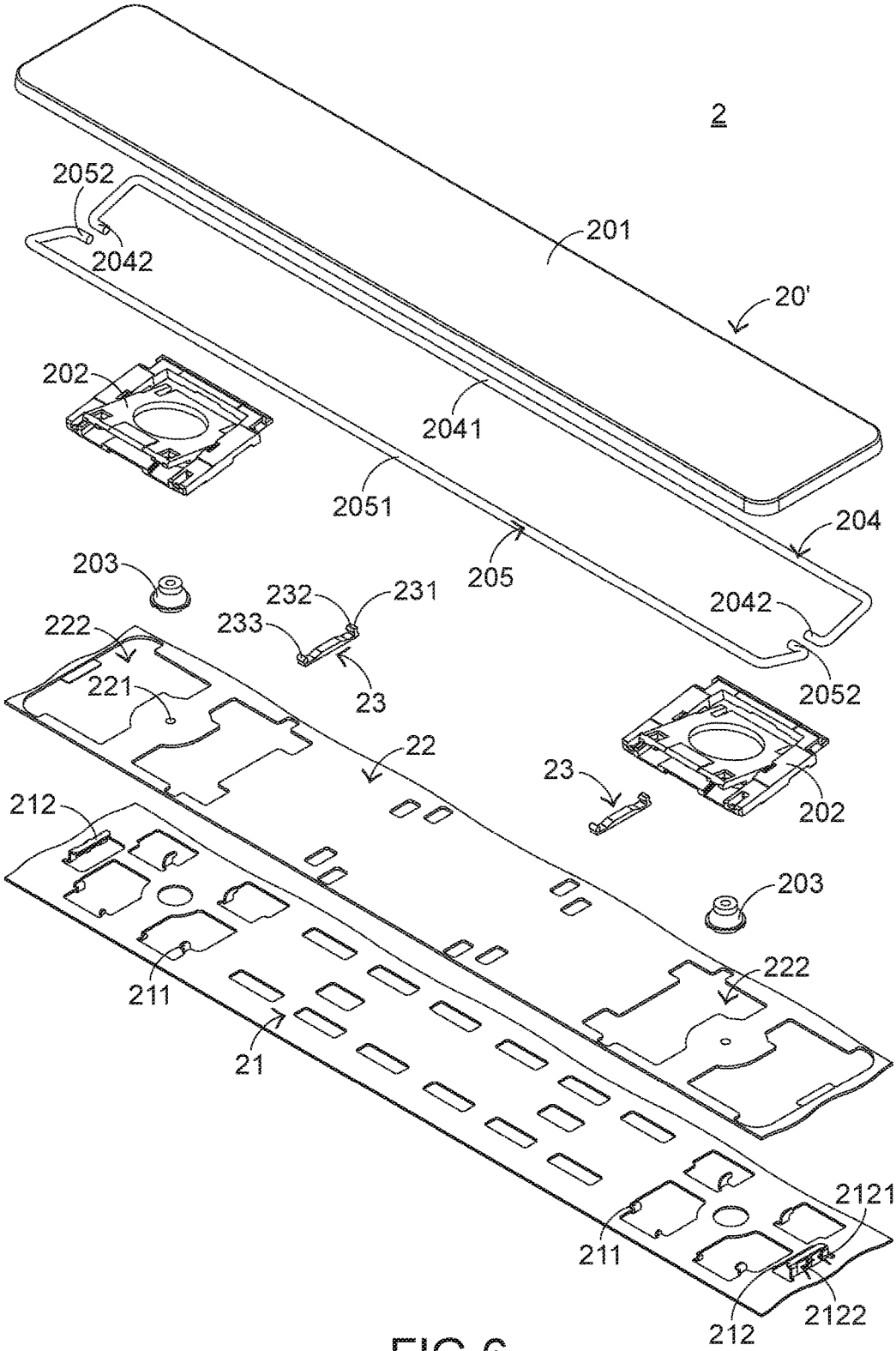
FIG. 6 is a schematic exploded view illustrating a portion of the keyboard device according to the first embodiment of the present invention and taken along a viewpoint.
Figure 7:
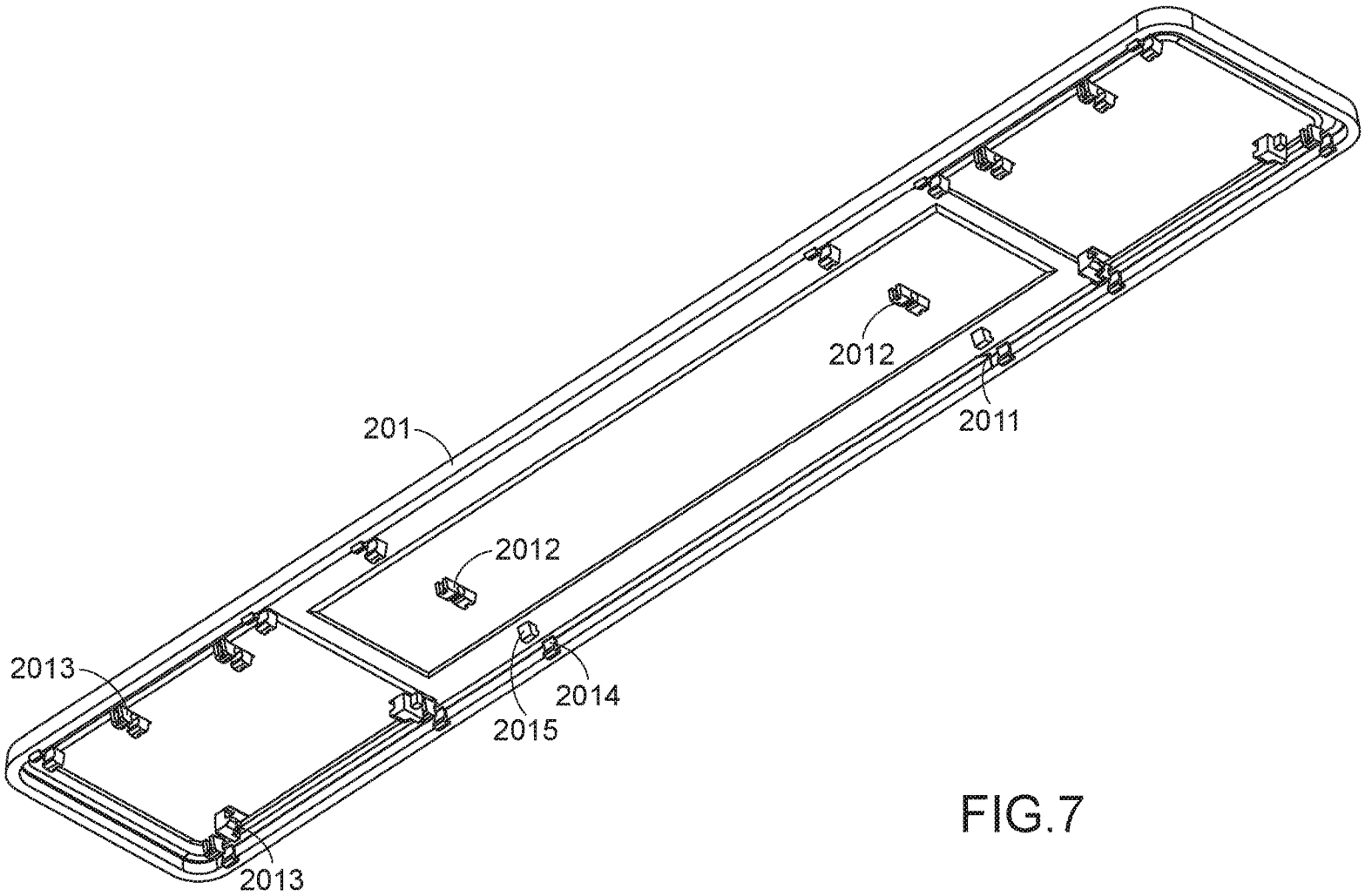
FIG. 7 is a schematic perspective view illustrating the keycap of the keyboard device according to the first embodiment of the present invention and taken along another viewpoint.

Hereinafter, the inner structure of the keyboard device 2 will be illustrated with reference to FIGS. 6 and 7. FIG. 6 is a schematic exploded view illustrating a portion of the keyboard device according to the first embodiment of the present invention and taken along a viewpoint. FIG. 7 is a schematic perspective view illustrating the keycap of the keyboard device according to the first embodiment of the present invention and taken along another viewpoint. In addition to the plural key structures 20 and 20', the keyboard device 2 further a base plate 21, a switch circuit board 22 and buffering strips 23. The base plate 21 is located under the plural key structures 20 and 20' and connected with the plural key structures 20 and 20'. The switch circuit board 22 is arranged between the plural key structures 20, 20' and the base plate 21. When the switch circuit board 22 is triggered by one of the plural key structures 20 and 20', a corresponding key signal is generated. The switch circuit board 22 comprises a key switch 221 and plural openings 222. Each key switch 221 of the switch circuit board 22 is aligned with a corresponding key structure 20 or 20'. When the key switch 221 is triggered by the corresponding key structure 20 or 20', the corresponding key signal is generated.

Each of the key structures 20' comprises a keycap 201, at least one scissors-type connecting element 202, an elastic element 203, a first stabilizer bar 204 and a second stabilizer bar 205. The scissors-type connecting element 202 is connected with the corresponding keycap 201 and the base plate 21. Through the scissors-type connecting element 202, the keycap 201 is fixed on the base plate 21 and moved relative to the base plate 21. The elastic element 203 is arranged between the corresponding keycap 201 and the switch circuit board 22, and aligned with the corresponding key switch 221. When the elastic element 203 is pushed by the keycap 201, the corresponding key switch 221 is triggered. In an embodiment, the base plate 21 is made of a metallic material, the elastic element 203 is a rubbery elastomer, and the scissors-type connecting element 202 is made of a plastic material.

Please refer to FIGS. 6 and 7 again. Both of the first stabilizer bar 204 and the second stabilizer bar 205 are connected with the keycap 201. The first stabilizer bar 204 comprises a first linking bar part 2041 and two first hook parts 2042. The first linking bar part 2041 is connected with the keycap 201. The two first hook parts 2042 are located at two ends of the first stabilizer bar 204, respectively. Similarly, the second stabilizer bar 205 comprises a second linking bar part 2051 and two second hook parts 2052. The second linking bar part 2051 is connected with the keycap 201. The two second hook parts 2052 are located at two ends of the second stabilizer bar 205, respectively. In this embodiment, the first linking bar part 2041 and the two first hook parts 2042 are integrally formed, and the first stabilizer bar 204 is made of metallic material or plastic material. Similarly, the second linking bar part 2051 and the two second hook parts 2052 are integrally formed, and the second stabilizer bar 205 is made of metallic material or plastic material.

The base plate 21 comprises plural base plate hooks 211 and plural connecting structures 212. The base plate hooks 211 are connected with the scissors-type connecting element 202. Consequently, the scissors-type connecting element 202 is fixed on the base plate 21. The connecting structures 212 are penetrated through openings 222 of the switch circuit board 22 and located over the switch circuit board 22. Consequently, the connecting structures 212 are connected with the first stabilizer bar 204 and the second stabilizer bar 205. Each of the connecting structures 212 comprises a first locking hole 2121 and a second locking hole 2122. The first hook parts 2042 of the first stabilizer bar 204 are penetrated through the corresponding first locking holes 2121, so that the first stabilizer bar 204 is fixed on the base plate 21. The second hook parts 2052 of the second stabilizer bar 205 are penetrated through the corresponding second locking holes 2122, so that the second stabilizer bar 205 is fixed on the base plate 21.

Moreover, the keycap 201 comprises plural first coupling structures 2011, plural second coupling structures 2012 and plural keycap hooks 2013. The plural keycap hooks 2013 are disposed on an inner surface of the keycap 201 and connected with the scissors-type connecting element 202. The plural first coupling structures 2011 are also disposed on an inner surface of the keycap 201. The first coupling structures 2011 are connected with the first linking bar part 2041. Consequently, the first linking bar part 2041 is fixed on the keycap 201. The plural second coupling structures 2012 are also disposed on an inner surface of the keycap 201. The plural second coupling structures 2012 are connected with the buffering strips 23. Consequently, the buffering strips 23 are fixed on the keycap 201.

As shown in FIG. 7, the first coupling structure 2011 is wider than the second coupling structure 2012. The first coupling structure 2011 comprises a supporting part 2014 and a locking part 2015. The supporting part 2014 is disposed on the inner surface of the keycap 201 and located at a first side of the first coupling structure 2011. The supporting part 2014 is used for supporting the first linking bar part 2041 of the first stabilizer bar 204. The locking part 2015 is disposed on the inner surface of the keycap 201 and located at a second side of the first coupling structure 2011. The locking part 2015 is engaged with a first end of the buffering strip 23. Due to the supporting part 2014 and the locking part 2015, the first linking bar part 2041 can be fixed in the first coupling structure 2011.

Figure 8:
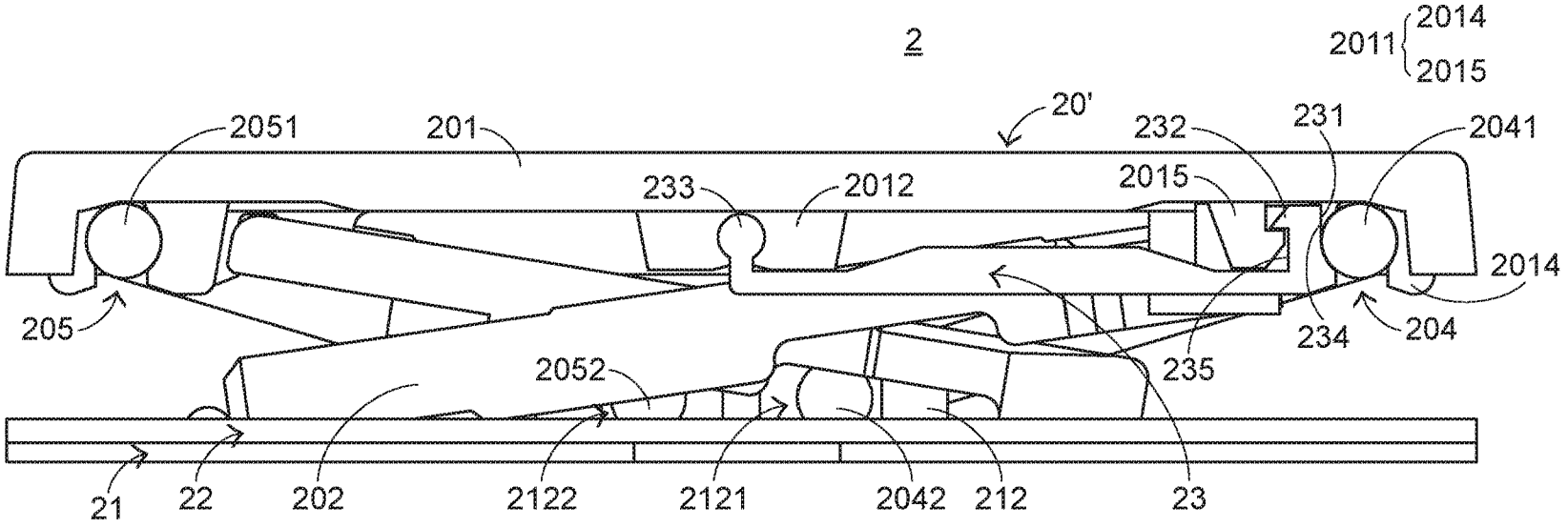
FIG. 8 is a schematic cross-sectional view illustrating a portion of the keyboard device according to the first embodiment of the present invention.

FIG. 8 is a schematic cross-sectional view illustrating a portion of the keyboard device according to the first embodiment of the present invention. The structure of the buffering strip 23 will be described as follows. The first end of the buffering strip 23 is fixed in the first coupling structure 2011 and contacted with the first linking bar part 2041 of the first stabilizer bar 204. A second end of the buffering strip 23 is fixed on the second coupling structure 2012. The buffering strip 23 is filled in the gap between the first stabilizer bar 204 and the first coupling structure 2011. Due to the buffering strip 23, the first linking bar part 2041 does not collide with the first coupling structure 2011. Consequently, the possibility of generating noise is minimized. In an embodiment, the buffering strip 23 comprises a sustaining part 231, an extension hook part 232 and a coupling post 233. The sustaining part 231 is located at the first end of the buffering strip 23 and formed on a first sidewall 234 of the buffering strip 23. The sustaining part 231 is contacted with the first linking bar part 2041 of the first stabilizer bar 204. The extension hook part 232 is located at the first end of the buffering strip 23 and formed on a second sidewall 235 of the buffering strip 23. The extension hook part 232 is coupled with the locking part 2015. The coupling post 233 is located at the second end of the buffering strip 23. The coupling post 233 is fixed in the second coupling structure 2012 of the keycap 201. Due to the extension hook part 232 and the coupling post 233, the first end and the second end of the buffering strip 23 can be fixed on the inner surface of the keycap 201. Preferably, the sustaining part 231, the extension hook part 232 and the coupling post 233 are integrally formed with the buffering strip 23. Moreover, the buffering strip 23 is made of plastic material.

The operations of depressing the key structure 20' will be described as follows. Please refer to FIGS. 6, 7 and 8. While the keycap 201 of any key structure 20' is depressed, the keycap 201 is moved downwardly relative to the base plate 21. Since the scissors-type connecting element 202 is pushed by the keycap 201, the scissors-type connecting element 202 is correspondingly swung. Moreover, as the keycap 201 is moved downwardly to push the elastic element 203, the elastic element 203 is subjected to deformation to trigger the corresponding key switch 221. Consequently, the corresponding key signal is generated. When the key structure 20' is no longer depressed, the keycap 201 is moved upwardly relative to the base plate 21 in response to a restoring elastic force of the elastic element 203. As the keycap 201 is moved upwardly, the scissors-type connecting element 202 is correspondingly swung and switched from the stacked state to the open-scissors state again. Consequently, the keycap 201 is returned to its original position.

As mentioned above, the coupling post 233 is fixed in the second coupling structure 2012. Moreover, as the keycap 201 is moved, the coupling post 233 is rotated relative to the second coupling structure 2012 and the buffering strip 23 is correspondingly swung. While the key 20' is depressed, the sustaining part 231 is continuously contacted with the first linking bar part 2041 and the movement of the keycap 201 is not hindered. In other words, the buffering strip 23 can provide the function of continuously reducing noise. Moreover, the buffering strip 23 is used as a connecting bridge between the first stabilizer bar 204 and the keycap 201. Even if rim of the keycap 201 is depressed by the user, the exerted force of the user can be transmitted to the first stabilizer bar 204 through the buffering strip 23. When compared with the conventional technology, the smoothness of the linkage between the first stabilizer bar 204 and the keycap 201 of the keyboard device 2 is largely enhanced.

In this embodiment, the buffering strip 23 is arranged between the first stabilizer bar 204 and the keycap 201 for reducing the collision between the first stabilizer bar 204 and the keycap 201. It is noted that numerous modifications and alterations may be made while retaining the teachings of the invention. For example, in another embodiment, another buffering strip 23 is arranged between the second stabilizer bar 205 and the keycap 201. Consequently, the noise is further reduced.

Figure 9:
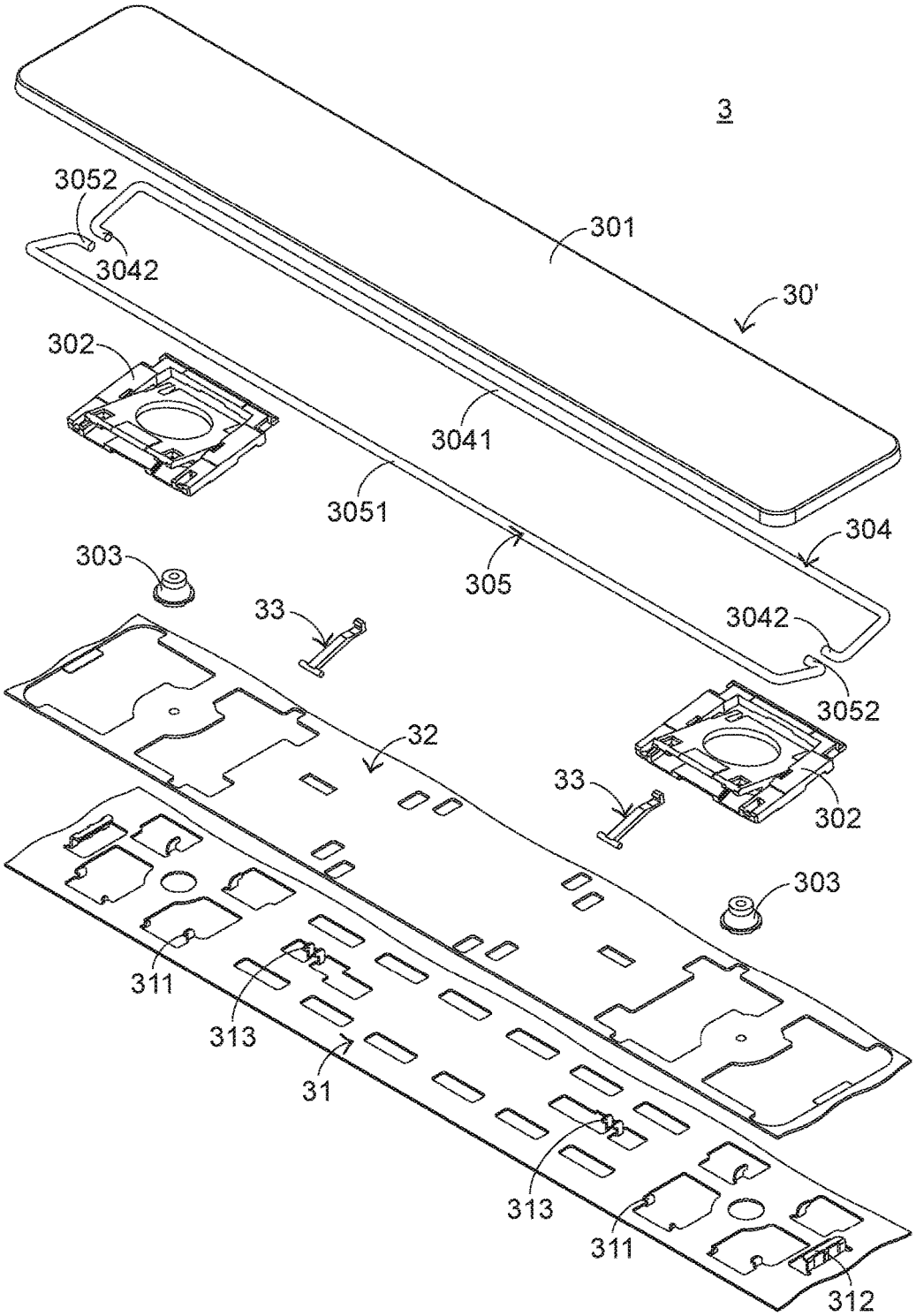
FIG. 9 is a schematic exploded view illustrating a portion of a keyboard device according to a second embodiment of the present invention and taken along a viewpoint.
Figure 10:
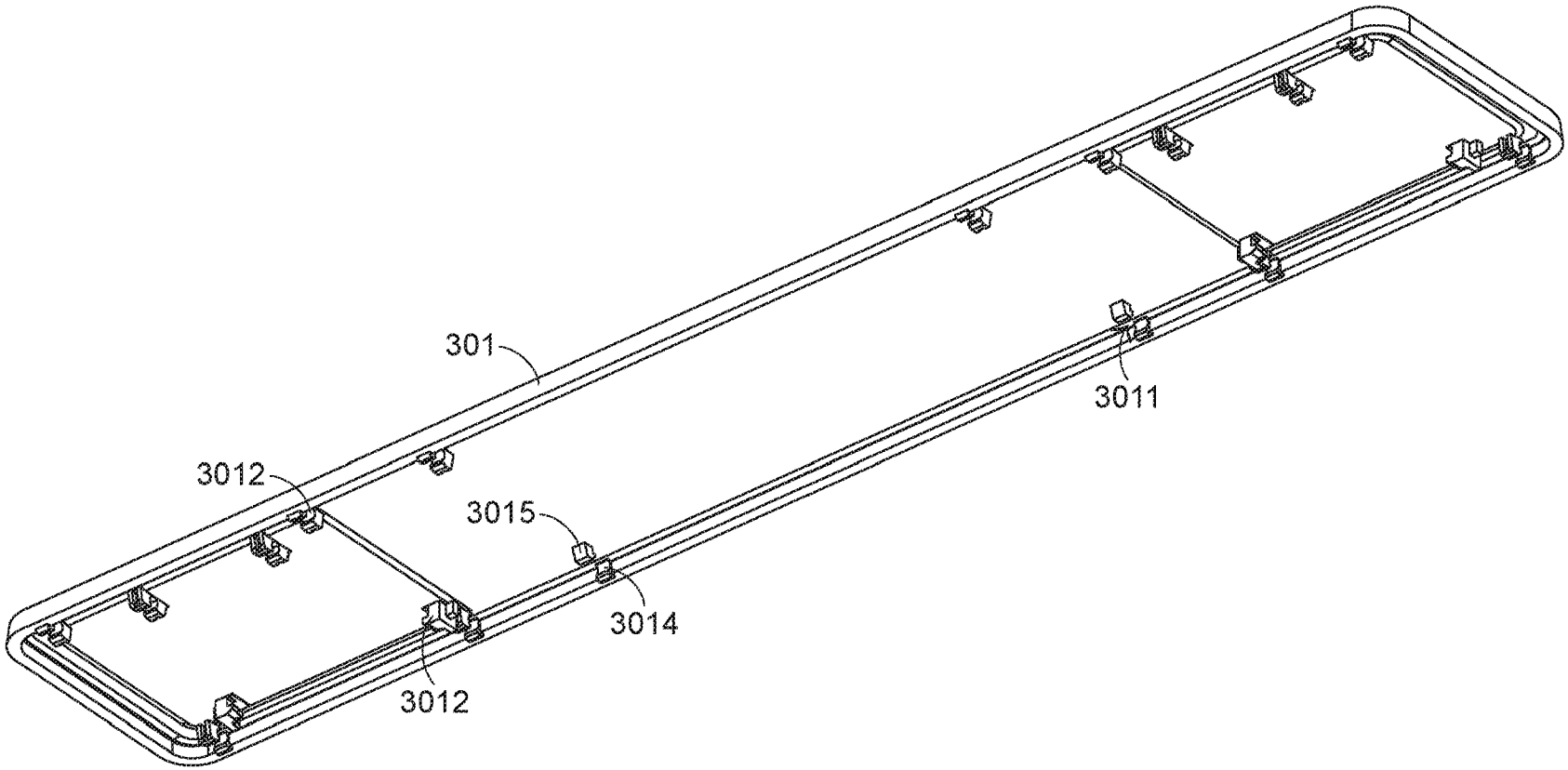
FIG. 10 is a schematic perspective view illustrating the keycap of the keyboard device according to the second embodiment of the present invention and taken along another viewpoint.

The present invention further provides a keyboard device of a second embodiment, which is distinguished from the first embodiment. FIG. 9 is a schematic exploded view illustrating a portion of a keyboard device according to a second embodiment of the present invention and taken along a viewpoint. FIG. 10 is a schematic perspective view illustrating the keycap of the keyboard device according to the second embodiment of the present invention and taken along another viewpoint. Please refer to FIGS. 9 and 10. In this embodiment, the keyboard device 3 comprises plural key structures 30', a base plate 31, a switch circuit board 32 and buffering strips 33. For brevity, only one key structure 30' is shown in the drawings. Each of the key structures 30' comprises a keycap 301, at least one scissors-type connecting element 302, an elastic element 303, a first stabilizer bar 304 and a second stabilizer bar 305. The first stabilizer bar 304 comprises a first linking bar part 3041 and two first hook parts 3042. The second stabilizer bar 305 comprises a second linking bar part 3051 and two second hook parts 3052. Except for the following three items, the structures of the keyboard device 3 of this embodiment are substantially identical to those of the keyboard device 2 of the first embodiment, and are not redundantly described herein. Firstly, the installation position of the buffering strip 33 is distinguished. Secondly, the structure of the base plate 31 is distinguished. Thirdly, the structure of the keycap 301 is distinguished.

As shown in FIGS. 9 and 10, the keycap 301 comprises plural first coupling structures 3011 and plural keycap hooks 3012. The first coupling structure 3011 comprises a supporting part 3014 and a locking part 3015. The second coupling structures 201 in the first embodiment are not formed on the keycap 301 of this embodiment. Similarly, the base plate 31 comprises plural base plate hooks 311 and plural connecting structures 312. Moreover, the base plate 31 further comprises plural second coupling structures 313. The second coupling structures 313 are disposed on the base plate 31 and connected with the second ends of the corresponding buffering strip 33.

Figure 11:
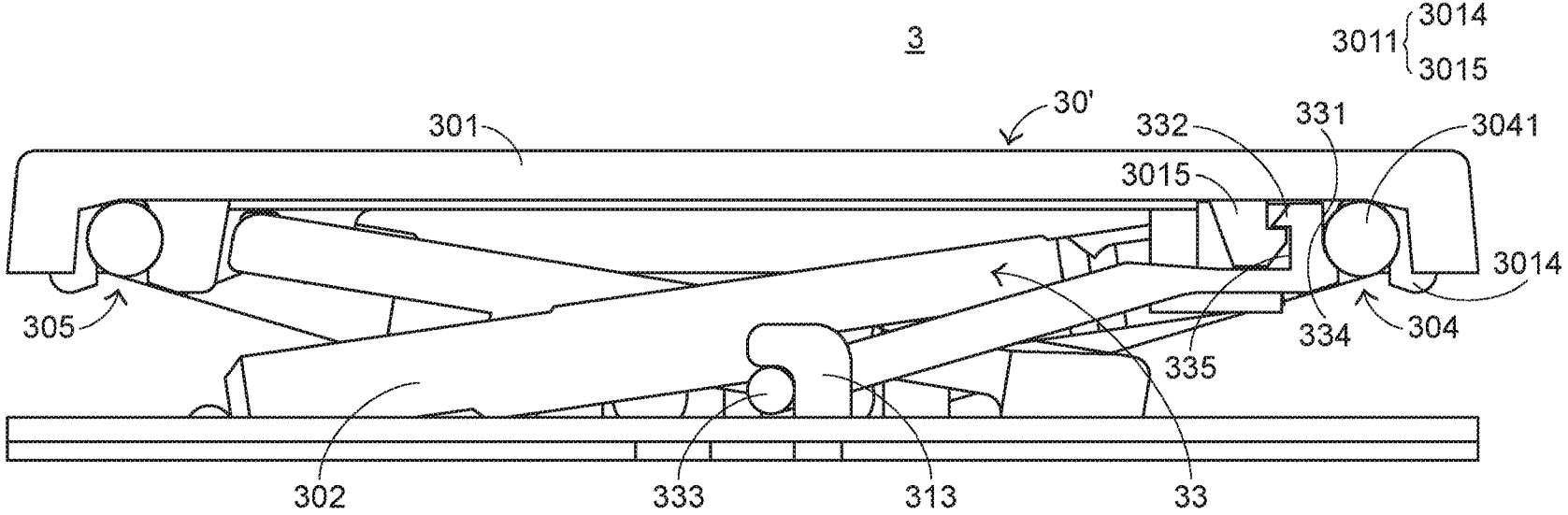
FIG. 11 is a schematic cross-sectional view illustrating a portion of the keyboard device according to the second embodiment of the present invention.

FIG. 11 is a schematic cross-sectional view illustrating a portion of the keyboard device according to the second embodiment of the present invention. The structure of the buffering strip 33 will be described as follows. The first end of the buffering strip 33 is fixed in the first coupling structure 3011 and contacted with the first linking bar part 3041 of the first stabilizer bar 304. The second end of the buffering strip 33 is fixed on the second coupling structure 313 of the base plate 31. In an embodiment, the buffering strip 33 comprises a sustaining part 331, an extension hook part 332 and a coupling post 333. The sustaining part 331 is located at the first end of the buffering strip 33 and formed on a first sidewall 334 of the buffering strip 33. The sustaining part 331 is contacted with the first linking bar part 3041 of the first stabilizer bar 304. The extension hook part 332 is located at the first end of the buffering strip 33 and formed on a second sidewall 335 of the buffering strip 33. The extension hook part 332 is coupled with the locking part 3015. The coupling post 333 is located at the second end of the buffering strip 33. The coupling post 333 is fixed in the second coupling structure 313 of the base plate 31.

Figure 12:
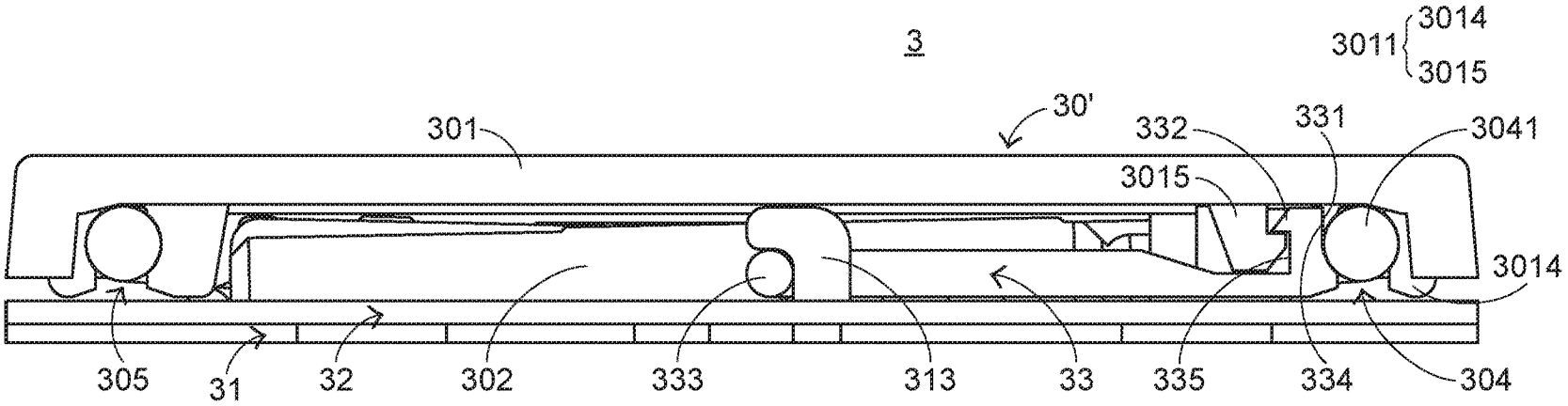
FIG. 12 is a schematic cross-sectional view illustrating a portion of the keyboard device according to the second embodiment of the present invention, in which the key structure is depressed.

FIG. 12 is a schematic cross-sectional view illustrating a portion of the keyboard device according to the second embodiment of the present invention, in which the key structure is depressed. As shown in FIG. 12, the key structure 30' is depressed. The first end of the buffering strip 33 is fixed on the keycap 301 through the extension hook part 332. Moreover, the second end of the buffering strip 33 is fixed on the base plate 31 through the coupling post 333. When the key structure 30' is in the depressed state, the buffering strip 33 is assembled with the key structure 30'. After the buffering strip 33 is assembled, the key structure 30' is restored to its original position from the depressed state. Consequently, the buffering strip 33 is correspondingly swung and subjected to deformation in response to its plastic elasticity. The operations of depressing the key structure 30' are similar to those of the first embodiment, and are not redundantly described herein.

From the above descriptions, the present invention provides the keyboard device. The buffering strip is arranged between the keycap and the stabilizer bar. Moreover, the buffering strip is fixed between the keycap and the base plate. The buffering strip is filled in the gap between the keycap and the stabilizer bar. Since the buffering strip is contacted with the stabilizer bar, the stabilizer bar is in close contact with the keycap and the possibility of resulting in the collision between the stabilizer bar and the keycap is minimized. Moreover, the buffering strip is used as a connecting bridge between the stabilizer bar and the keycap. The depressing force received by the keycap can be transmitted to the stabilizer bar through the buffering strip. Since the linkage between the stabilizer bar and the keycap becomes smoother, the tactile feel of depressing the key structure is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a key structure comprising a keycap and a stabilizer bar, wherein the keycap is exposed outside the keyboard device and comprises a first coupling structure, and the stabilizer bar is located under the keycap and fixed in the first coupling structure;

a switch circuit board located under the key structure, wherein when the switch circuit board is triggered, a key signal is generated;

a base plate located under the switch circuit board and connected with the stabilizer bar, wherein the key structure is supported by the base plate; and a buffering strip, wherein a first end of the buffering strip is fixed in the first coupling structure and contacted with the stabilizer bar, wherein the buffering strip is filled in a gap between the stabilizer bar and the first coupling structure.

2. The keyboard device according to claim 1, wherein the first coupling structure comprises:

a supporting part disposed on an inner surface of the keycap and located at a first side of the first coupling structure, wherein the stabilizer bar is supported by the supporting part; and a locking part disposed on the inner surface of the keycap and located at a second side of the first coupling structure, wherein the locking part is engaged with the first end of the buffering strip.

3. The keyboard device according to claim 2, wherein the buffering strip comprises:

a sustaining part located at the first end of the buffering strip and formed on a first sidewall of the buffering strip, wherein the sustaining part is contacted with the stabilizer bar;

an extension hook part located at the first end of the buffering strip and formed on a second sidewall of the buffering strip, wherein the extension hook part is coupled with the locking part; and a coupling post located at a second end of the buffering strip and fixed on the keycap or the base plate.

4. The keyboard device according to claim 3, wherein the sustaining part, the extension hook part and the coupling post are integrally formed with the buffering strip.

5. The keyboard device according to claim 3, wherein the keycap further comprises a second coupling structure, and the second coupling structure is disposed on an inner surface of the keycap, wherein the second coupling structure is engaged with the coupling post, so that the second end of the buffering strip is fixed on the keycap.

6. The keyboard device according to claim 3, wherein the keycap further comprises a second coupling structure, and the second coupling structure is disposed on the base plate, wherein the second coupling structure is engaged with the coupling post, so that the second end of the buffering strip is fixed on the base plate.

7. The keyboard device according to claim 3, wherein the base plate further comprises a connecting structure, and the connecting structure is disposed on the base plate and connected with the stabilizer bar, wherein the connecting structure comprises a locking hole, and the stabilizer bar is penetrated through the locking hole, so that the stabilizer bar is fixed on the base plate.

8. The keyboard device according to claim 7, wherein the stabilizer bar comprises:

a linking bar part fixed in the first coupling structure and connected with the keycap; and a hook part located at an end of the linking bar part and aligned with the locking hole, wherein the hook part is penetrated through the locking hole, so that the stabilizer bar is fixed on the base plate.

9. The keyboard device according to claim 8, wherein the linking bar part and the hook part are integrally formed with the stabilizer bar, and made of metallic material or plastic material.

10. The keyboard device according to claim 1, wherein the key structure further comprises:

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board, wherein when the elastic element is pushed by the keycap, the switch circuit board is triggered by the elastic element, wherein when the elastic element is not pushed by the keycap, the elastic element provides an elastic force to the keycap.

* * * * *